US006612446B1

(12) United States Patent
Scriba et al.

(10) Patent No.: US 6,612,446 B1
(45) Date of Patent: Sep. 2, 2003

(54) ROLL FOR SPREADING AND SLOWING DOWN POURABLE MATERIALS

(75) Inventors: Joerg Scriba, Ortenberg (DE); Walter Henschel, Otzberg (DE)

(73) Assignee: Dieffenbacher Schenck Panel GmbH, Pfungstadt (DE)

( * ) Notice: Subject to any disclaimer, the term of this patent is extended or adjusted under 35 U.S.C. 154(b) by 0 days.

(21) Appl. No.: 09/807,111

(22) PCT Filed: Oct. 7, 1999

(86) PCT No.: PCT/EP99/07516

§ 371 (c)(1),
(2), (4) Date: Apr. 6, 2001

(87) PCT Pub. No.: WO00/20180

PCT Pub. Date: Apr. 13, 2000

(30) Foreign Application Priority Data

Oct. 7, 1998 (DE) ..... 198 46 107

(51) Int. Cl.[7] ..... B07B 1/54

(52) U.S. Cl. ..... 209/382; 209/381; 209/659; 209/660; 209/664; 209/667; 209/672; 209/673; 209/683; 209/254

(58) Field of Search ..... 209/659–660, 209/664, 667, 671, 672, 673, 683, 381, 382, 254

(56) References Cited

U.S. PATENT DOCUMENTS

| | | | | | |
|---|---|---|---|---|---|
| 2,862,620 | A | * | 12/1958 | Van Zelst, Jr. | 209/237 |
| 3,315,804 | A | * | 4/1967 | Brauchla | 209/277 |
| 3,472,372 | A | * | 10/1969 | Webb | 209/10 |
| 3,715,941 | A | * | 2/1973 | Andrews et al. | 29/235 |
| 4,025,254 | A | | 5/1977 | Arnold | |
| 4,359,151 | A | | 11/1982 | Fyie et al. | |
| 4,834,672 | A | * | 5/1989 | Michely | 439/417 |
| 5,051,171 | A | * | 9/1991 | Hukki | 209/323 |
| 5,266,161 | A | * | 11/1993 | Kroeker | 127/2 |
| 5,368,167 | A | * | 11/1994 | Howes | 198/759 |
| 5,662,227 | A | | 9/1997 | Laitinen | |
| 5,922,254 | A | | 7/1999 | Ebert et al. | |
| 6,062,394 | A | * | 5/2000 | Bielagus | 209/310 |
| 6,095,339 | A | * | 8/2000 | Filip | 209/379 |

FOREIGN PATENT DOCUMENTS

| | | |
|---|---|---|
| DE | 1506890 | 8/1969 |
| DE | 2611846 | 11/1976 |
| DE | 2611847 | 11/1976 |
| DE | 29511758 | 11/1995 |
| EP | 0800901 | 10/1997 |

* cited by examiner

*Primary Examiner*—Donald P. Walsh
*Assistant Examiner*—Jeffrey A. Shapiro
(74) *Attorney, Agent, or Firm*—W. F. Fasse; W. G. Fasse

(57) ABSTRACT

A spreading roll for spreading out a chip fleece for producing wood chip material or similar panels, includes two disk-shaped end pieces (3, 7), plural thin spokes (6), rods, pipes or cords arranged extending between the end pieces, and pipe-shaped loose sheaths (9, 10, 11, 12, 13) arranged on the spokes or the like for preventing the adhesion of fibrous materials or contaminants on the spokes or the like.

20 Claims, 2 Drawing Sheets

ROLL FOR SPREADING AND SLOWING DOWN POURABLE MATERIALS

FIELD OF THE INVENTION

The invention relates to a roll for spreading and braking or slowing down pourable materials.

BACKGROUND INFORMATION

In the production of material panels of spreadable or pourable materials, such as in the production of chipboard panels for example, a mixture of wood chips or fibrous materials and binder agents are spread into a fleece layer on a substrate or support. For this, the substrate is usually a continuously moved conveyor belt, which transports the chip fleece to a press. A problem in the production of such material panels exists in achieving a uniform spreading and mixing of the chips provided with binder agents, in order to spread a flat or planar uniform layer onto the transport belt. To achieve this, a so-called spoke roll is known as a spreading roll which is arranged in a spreading chamber, from the EP 0 800 901 A1. This spoke roll is characterized in that it consists of at least two end disks, between which spokes are arranged under stress over the entire spreading width. The wood particles provided with binder agents are very uniformly intermixed by the rotating spreading roll, so that a uniform chip fleece is spreadable therewith.

In recent times, frequently recycled materials are being processed into chips, which often contain longer fiber components and foreign materials such as hairs and synthetic fibers. Thus, these fibers and foreign materials become more and more wrapped or wound around the thin rods or spokes and thus progressively ever more plug or clog the spreading roll. For this reason it is necessary to clean the wound-up fibers off of the spokes of the spreading roll, at certain time intervals. This is very complicated or time-consuming and cost intensive because the panel production must be interrupted during this time.

SUMMARY OF THE INVENTION

Therefore, the invention is based on the object, to improve a spreading roll of the above described type in such a manner so that to the extent possible no contaminants become caught or deposited on the spokes or rods. This object has been achieved according to the invention in a spreading roll comprising two end disks, plural elongate members extending between the two end disks, and a respective loose sheath loosely arranged on and extending along each one of the plural elongate members, which may have the form of spokes, rods, pipes or cords.

The invention has the advantage, due to the inventive loose jacketing or sheathing of the spokes, that the spreading roll basically does not need to be constructively altered in order to prevent such contaminations of the spokes. Therefore, in an advantageous manner, also existing spoke rolls can be retrofitted with such a winding or wrapping protection.

Since the chips turbulently mix with one another differently in connection with wound-up spokes or rods in comparison to clean rod or spokes, therefore the quality of the spreading also varies with increasing contamination. Thus, in an advantageous manner, the jacketing or sheathing of the spokes ensures a constant spreading quality and therewith a uniform quality of the chipboard panels.

Moreover, the invention increases the operating reliability and operating life of the roll in an advantageous manner, because the weight of the spokes and of the roll will be increased by a plugged or clogged spreading roll, whereby this easily leads to spoke breaks and bearing damages.

BRIEF DESCRIPTION OF THE DRAWINGS

The invention will be described in detail below in connection with example embodiments, which are shown in the drawings. In the drawings.

DETAILED DESCRIPTION OF PREFERRED EXAMPLE EMBODIMENTS OF THE INVENTION

Figure 1:
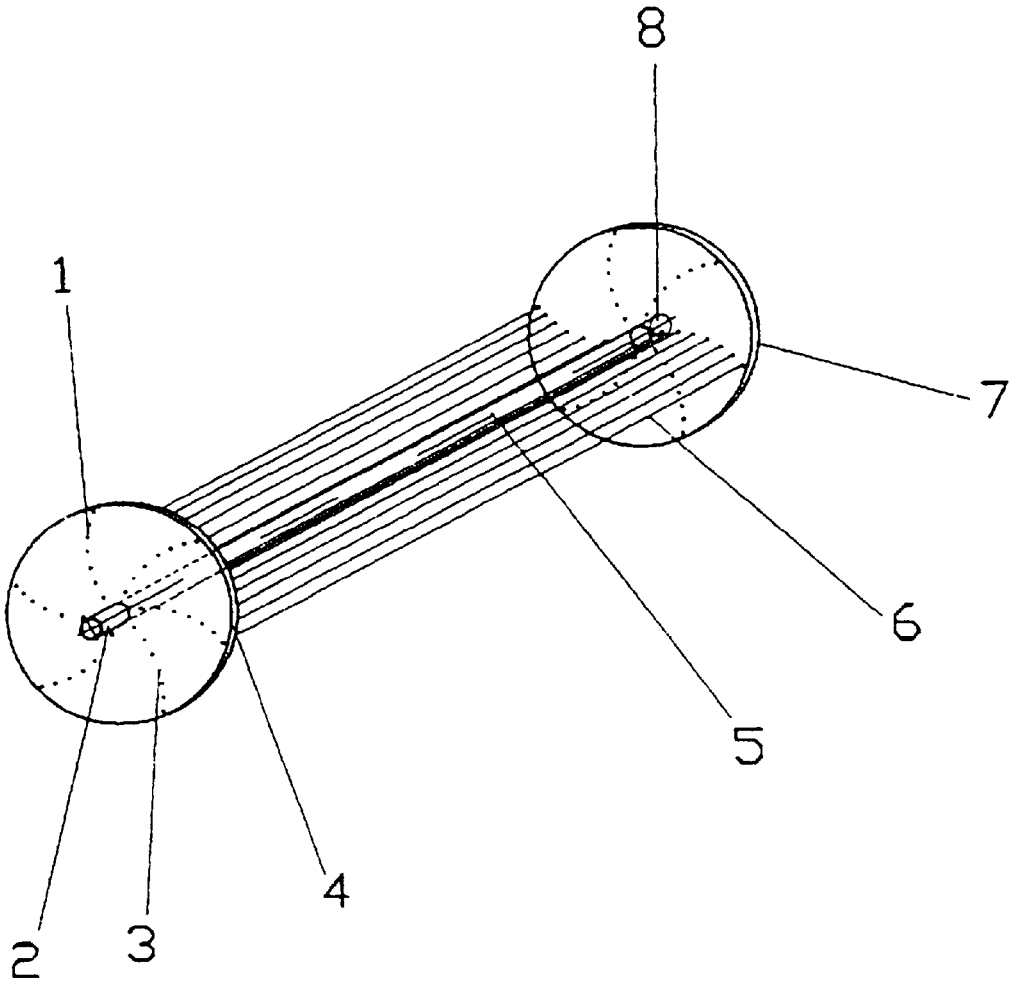
Fig.1 PRIOR ART
FIG. 1 shows a spreading roll as a conventional spoke roll.

FIG. 1 of the drawings shows a spreading roll in the form of a spoke roll according to the conventional state of the art. The spreading roll consists of a central through-going shaft 5, on the ends of which two end disks 4, 7 are mounted. The end portions of the central shaft are embodied as bearing locations 2, 8, which are provided for the bearing support and for driving the spreading roll in a spreading chamber which is not shown.

The end disks 4,7 are embodied as perforated disks and are rigidly secured on the shaft 5. The hole rows 1, 3 go from the center in the form of rays to the outer circumference and form a semi-circular shaped curved line. Thin spokes 6 are inserted or pulled into the holes of the end disks 4, 7, whereby the spokes 6 radially maintain a prescribed spacing distance from one another, through which the chips or fiber parts provided with binder agent can fall through. For the sake of clarity, only two hole rows are shown with spokes in FIG. 1 of the drawing. In an actual spoke roll, quite often five hole rows with respectively seven spokes are provided, which are arranged around the shaft 5. In this context, the shaft 5 especially serves as a drive axle and as a spacing distance holder of the end disks 4, 7.

In the operating condition, the spreading roll and braking or slowing-down roll rotates with a prescribed rotational speed and intermixes the chips or fibers that have been directed onto the roll and that have been glued or had an adhesive applied thereon, in order to spread these chips or fibers in a uniform crosswise distribution onto a substrate which is not shown. In this context, the glued or adhesive-coated wood chips will fall downwardly through the spoke roll by means of gravitational force. Due to the rotation, the adhesive-coated wood chips strike against the revolving spokes 6 and thereby become additionally accelerated in all possible directions, so that a good dissolution or breaking-up of still-existing agglomerations or chip clumps is achieved and simultaneously a good intermixing of the different chip sizes additionally arises.

However, the glued or adhesively coated spreadable bulk goods also contain longer fiber components and fibrous foreign materials, such as especially crinkled hairs, synthetic plastics or plant residues, which frequently wrap or wind themselves around the spokes 6, and over time, clog or plug the roll. Such a winding or wrapping up of the spoke rods 6 occurs more pronounced with relatively thin spokes. These are preferably used in order to achieve a light roll construction which also only require small drive powers and possess a high throughput capacity of the spreadable goods in connection with the best spreading characteristics.

Figure 2:
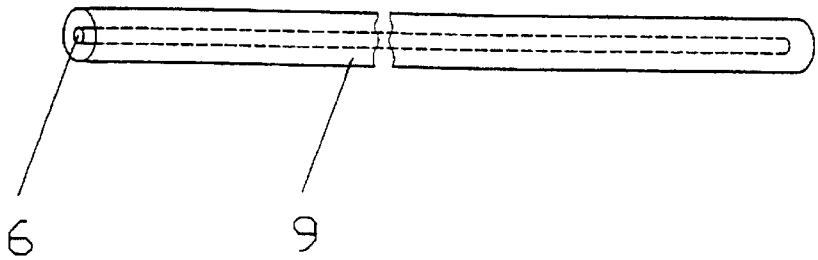
FIG. 2 shows a spoke with a pipe-shaped sheath according to the invention.

It has nonetheless been shown, in spreading rolls that were outfitted with thicker crosswise rods or pipes instead of spokes, that the quantity of the wound or wrapped-up residues was reduced but not completely preventable. This effect is still reduced to the extent that fiber components were still present in the spreadable goods, of which the length was greater than the circumference of the crosswise rods or the pipes. Therefore, the spokes 6 or rods were provided according to the invention with a jacket or sheath 9 according to FIG. 2. of the drawing. This sheath 9 preferably consists of a pipe-shaped body of which the inner diameter is greater than the outer diameter of the thin spokes 6. Instead of the spokes, the spreading roll or braking or slowing-down roll can also be provided with thin rods, pipes or cords. The length of the sheath 9 is thereby slightly shorter than that of the spokes 6, rods, pipes or cords, so that the sheath 9 only loosely lies on the spokes 6, rods, pipes or cords. The sheath 9 can be embodied as one piece or also in a multi-piece manner in the lengthwise direction.

Surprisingly it has been found that even longer fiber components do not wind or wrap themselves around the sheath 9, even if these are considerably longer than the circumference of the sheath. This can be attributed to the fact that the sheath 9 does not necessarily or enforcedly rotate about its own axis due to the rotating roll, and therefore does not develop any significant rotational moment which could wrap or wind the longer fibers tightly around the spoke 6, the rods, the pipes, or the cords. In this context, sheaths of which the inner diameter is approximately twice as large as the spoke diameter, so that the center of gravity of the sheath lies significantly below the spoke axis, have been proved to be particularly advantageous. Thereby it is achieved that during the rotation of the spreading roll, the sheath is not forced to rotate about its own axis. Thereby, a winding or wrapping-up of the longer fiber components is nearly excluded. Rather, this even frequently gives rise to a tumbling motion of the sheath, which preferably loosens crinkled adhering fiber components and thereby develops a certain additional self-cleaning effect.

Figure 3:
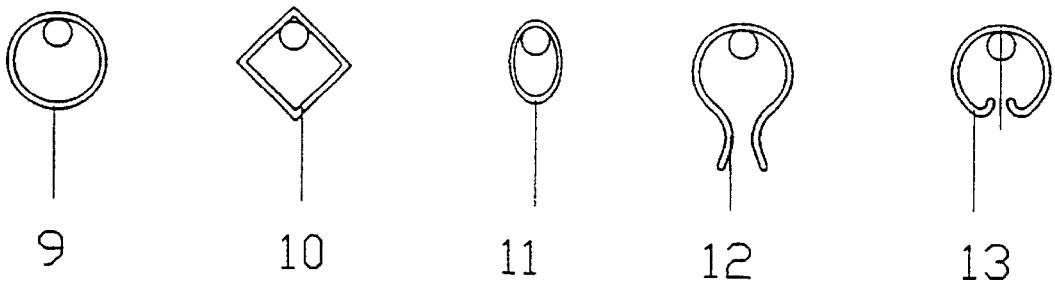
FIG. 3 shows various cross-sections of alternative sheaths.

Several cross sectional forms of alternative sheaths that are preferably usable are shown in FIG. 3 of the drawing. In this context, the cross section of a sheath according to FIG. 2 of the drawing, which is embodied as a round pipe 2, is shown on the left side. Sheaths of which the cross section 10 is rectangular or quadratic or square are also usable. In this context, a winding or wrapping-up is especially thereby prevented, in that the corners make a looping-around of the long fibers more difficult and effectively prevent a rotation due to the shifting displacement of the center of gravity.

An oval cross section 11 of the sheath is also provided, which does not significantly reduce the through-passage cross section through the spreading roll, in an advantageous manner, so that a high throughput capacity of the roll is achieved with a stable rotation position of the sheath.

Embodiments of a sheath 12, 13 are also provided, which contain a lengthwise extending slit, for after-equipping or retro-fitting existing spreading rolls. Such slits must however be smaller than the diameter of the spokes, rods, pipes or wires, in order not to be released from the spreading roll during a rotation thereof. In this context, the sheaths 12, 13 are embodied elastically so that they can be snapped onto the spokes, rods, pipes or cords. In this context it is especially advantageous to embody the slit's lengthwise edges in such a manner that these are oriented pointing inwardly. In this manner it is achieved in an especially advantageous manner that an automatic or self-actuated releasing of the sheath 13 from the spoke 6 is nearly excluded.

The sheaths 9, 10, 11, 12, 13 are preferably fabricated of thin-walled lightweight synthetic plastic, so that the weight of the spreading roll is not significantly increased. Sheaths of polypropylene, polyethylene or Teflon, which already due to their material characteristics have anti-adhering effects, have been found to be especially useful. However, sheaths of metal or metal-synthetic plastic composites or compounds are also suitable.

What is claimed is:

1. A spreader roll for spreading and slowing down pourable materials with two end disks, between which a plurality of elongate members selected from the group consisting of thin spokes, rods, pipes and cords are arranged, characterized in that the elongate members are each respectively surrounded with a respective loose sheath (9, 10, 11, 12, 13).

2. The spreader roll according to claim 1, characterized in that the sheath (9, 10, 11, 12, 13) is pipe-shaped whereby the inner diameter of the sheath is larger than the outer diameter of the elongate members.

3. The spreader roll according to claim 1, characterized in that the cross section of the sheath (9, 10, 11, 12, 13) is round, quadratic, rectangular, polygon-shaped, oval, or in shapes varied and derived therefrom.

4. The spreader roll according to claim 1, characterized in that the sheath (9, 10, 11, 12, 13) comprises a lengthwise slit, which is so embodied, that the sheath (12, 13) can be snapped onto the respective elongate member.

5. The spreader roll according to claim 1, characterized in that the sheath (9, 10, 11, 12, 13) is embodied in a one-piece or multi-piece manner in the lengthwise direction.

6. The spreader roll according to claim 1, characterized in that the sheath (9, 10, 11, 12, 13) consists of metal, plastic or a metal-plastic compound.

7. A spreader roll for spreading loose particulate material, comprising:

two end disks arranged parallel and spaced apart relative to each other, and being rotatable about a rotation axis passing through said two end disks;

plural elongate members respectively connected to and extending between said two end disks parallel to said rotation axis; and plural loose elongate sheaths, wherein a respective one of said sheaths is loosely arranged on each respective one of said elongate members so that said respective sheath is free to rotate and revolve about said respective elongate member on which said respective sheath is loosely arranged.

8. The spreader roll according to claim 7, wherein said respective sheath has a hollow cylindrical shape with an inner diameter that is larger than an outer diameter of said respective elongate member.

9. The spreader roll according to claim 8, wherein said inner diameter of said respective sheath is equal to twice said outer diameter of said respective elongate member.

10. The spreader roll according to claim 7, wherein said respective sheath has a circular cross-sectional shape.

11. The spreader roll according to claim 7, wherein said respective sheath has a square or rectangular cross-sectional shape.

12. The spreader roll according to claim 9, wherein said respective sheath has an oval cross-sectional shape.

13. The spreader roll according to claim 7, wherein said respective sheath has a longitudinally extending slit that opens into a hollow interior of said respective sheath, wherein said elongate member can pass through said slit into said hollow interior so that said respective sheath can thereby be snapped onto said respective elongate member.

14. The spreader roll according to claim 13, wherein said slit is bounded by slit edges of said sheath that are oriented inwardly into said hollow interior.

15. The spreader roll according to claim 7, wherein only a single one of said sheaths, which is an integral one-piece member, is arranged respectively on each of said elongate members.

16. The spreader roll according to claim 7, wherein said respective sheath comprises a plurality of separate individual sheath parts arranged in succession along said respective elongate member.

17. The spreader roll according to claim 7, wherein said respective sheath consists of a metal.

18. The spreader roll according to claim 7, wherein said respective sheath consists of a plastic.

19. The spreader roll according to claim 7, wherein said respective sheath consists of a metal-plastic composite.

20. The spreader roll according to claim 7, wherein respective ones of said plural elongate members are located at plural different radial distances from said rotation axis.

* * * * *

UNITED STATES PATENT AND TRADEMARK OFFICE

CERTIFICATE OF CORRECTION

PATENT NO. : 6,612,446 B1
DATED : September 2, 2003
INVENTOR(S) : Scriba et al.

It is certified that error appears in the above-identified patent and that said Letters Patent is hereby corrected as shown below:

Column 4,
Line 10, after "roll" replace "for spreading and slowing" by -- the spreads and slows --;
Line 11, after "materials", replace "with" by -- comprising --.
Line 21, after "(9, 10, 11, 12, 13)", replace "is" by -- has a shape selected from the group consisting of --;
Line 22, after "oval,", replace "or in" by -- and --;
Line 23, after "shapes", delete "varied and".
Line 29, after "in", insert -- a manner selected from the group consisting of --;
Line 30, before "multi-piece", replace "or" by -- manner and a --.
Line 32, after "of", insert -- a material selected from the group consisting of --;
Line 33, before "a", replace "or" by -- and --.
Line 34, after "roll", replace "for spreading" by -- that spreads --.
Line 58, after "a", insert -- cross-sectional shape selected from the group consisting of --, after "square", replace "or" by -- and --;
Line 59, replace "shape." by -- shapes. --.
Line 60, after "claim", replace "9," by -- 7, --.

Signed and Sealed this

Twenty-third Day of December, 2003

JAMES E. ROGAN
*Director of the United States Patent and Trademark Office*